US007909315B2

(12) United States Patent
Hill

(10) Patent No.: US 7,909,315 B2
(45) Date of Patent: Mar. 22, 2011

(54) CLAMPING APPARATUS

(76) Inventor: Thomas C. Hill, Woodbury, MN (US)

( * ) Notice: Subject to any disclaimer, the term of this patent is extended or adjusted under 35 U.S.C. 154(b) by 522 days.

(21) Appl. No.: 12/148,661

(22) Filed: Apr. 22, 2008

(65) Prior Publication Data

US 2009/0261520 A1 Oct. 22, 2009

(51) Int. Cl.
*B25B 5/14* (2006.01)

(52) U.S. Cl. ..... 269/118; 269/104; 269/111

(58) Field of Classification Search ..... 269/104, 269/111, 118
See application file for complete search history.

(56) References Cited

U.S. PATENT DOCUMENTS 4,427,191 A 1/1984 Hess
4,547,255 A 10/1985 Yow
4,552,345 A 11/1985 Benda
4,952,269 A 8/1990 Mortoly
5,058,870 A * 10/1991 Cetnar ..... 269/118
5,467,972 A * 11/1995 Lee et al. ..... 269/118
6,726,192 B2 * 4/2004 Devers ..... 269/25
6,779,576 B2 8/2004 Cable

* cited by examiner

*Primary Examiner* — Joseph J Hail, III
*Assistant Examiner* — Shantese McDonald

(57) ABSTRACT

A non-power operated clamping apparatus is disclosed which is made up of a top section, middle section, and bottom section. There are first direction clamps located on the left side and right side of the middle section and the bottom section is positioned within the first direction clamps and the sides of the middle section. There are second direction clamps between the bottom section and middle section and between the top section and middle section. The workpiece, comprising members of wood glued edge-to-edge, is placed between the top section and middle section and subjected to a first direction compressive force and a second direction compressive force perpendicular to the first direction compressive force.

19 Claims, 6 Drawing Sheets

CLAMPING APPARATUS

FIELD OF THE INVENTION

The present invention is a non-power operated clamping apparatus that can be used to clamp a plurality of wood pieces using two perpendicular compressive forces.

BACKGROUND OF THE INVENTION

Wood panels can be constructed by gluing a number of boards, edge-to-edge, to form a flat panel. Pipe clamps or other types of clamps are typically used to squeeze the boards together. The clamps are placed on both sides of the boards to reduce bowing. Even then, there is a high probability that the boards will be bowed after the clamping process which makes them difficult to use in subsequent operations and in many cases, they must be scrapped. A wood panel made with boards glued edge-to-edge needs to be flat for subsequent operations.

SUMMARY OF THE INVENTION

The present invention is a clamping apparatus that clamps boards to make a flat panel. It is a non-power operated clamping apparatus which is made up of a top section, middle section, and bottom section. There are first direction clamps located on the left side and right side of the middle section. The bottom section fits within the first direction clamps and the front and back sides of the middle section. There are crosswalls between the front side and back side of the bottom section which are parallel to the left and right sides of the bottom section. There are second direction clamps between the bottom section and the middle section that clamp the bottom section to the middle section in a second direction about perpendicular to the first direction compressive force. This creates a flat bed formed by the top of the sides of the middle section and the top of the sides and crosswalls of the bottom section.

The workpiece, composed of individual pieces of wood that are glued edge-to-edge, is placed on the above flat bed in the first direction clamps. The first direction clamps compress the workpiece in a first direction. Spacer bars are placed adjacent to the workpiece to insure that the headpiece of the first direction clamp is outside and not in contact with the front side of the middle section to be able to compress the workpiece. The top section is placed on top of the workpiece and middle section. There are crosswalls between the front side and back side of the top section which are parallel to the left and right sides of the top section. There are second direction clamps between the middle section and the top section that compress the workpiece in a second direction about perpendicular to the first direction compressive force.

DETAILED DESCRIPTION OF THE INVENTION

Figure 1:
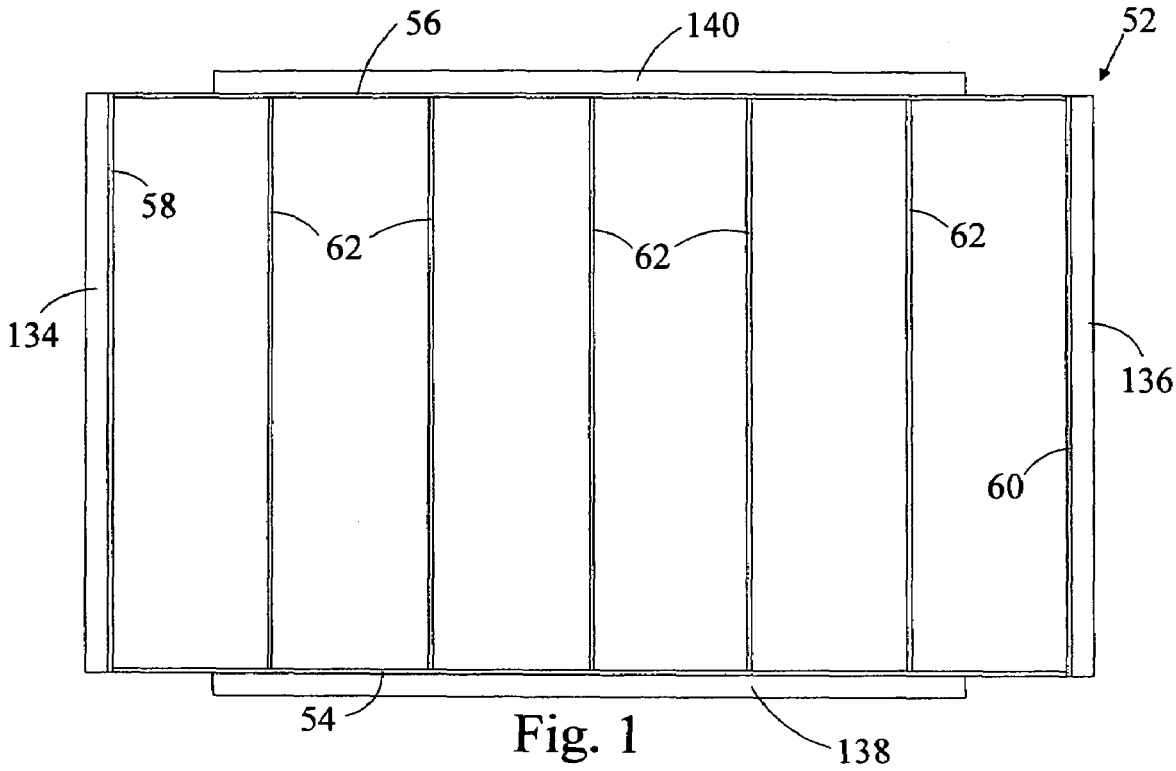
FIG. 1 is a top view of the top section of the present invention.
Figure 2:
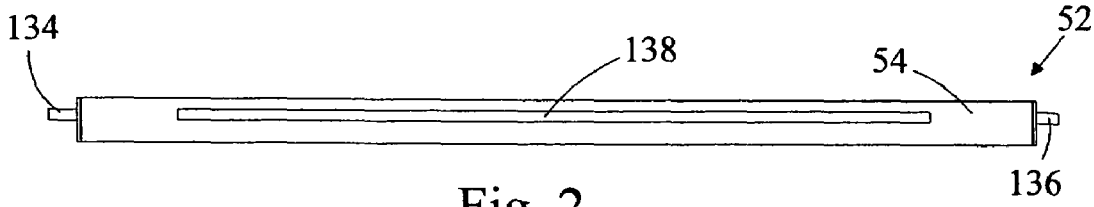
FIG. 2 is a front view of the top section of the present invention.
Figure 3:
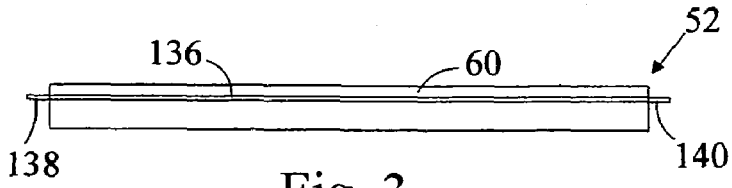
FIG. 3 is a side view of the top section of the present invention.

Like reference characters refer to like parts throughout the several figures of the clamping apparatus. FIG. 1 is a top view of the top section 52 which is rectangular in shape. It has a front side 54, a back side 56, a left side 58, a right side 60, and crosswalls 62 that extend from the front side 54 to the back side 56 and are substantially parallel to the left side 58 and the right side 60. There is a clamping bar 134 on the left side 58 and a clamping bar 136 on the right side 60. There is a clamping bar 138 attached to the front side 54 and a clamping bar 140 attached to the back side 56 of the top section 52. FIG. 2 is a front view of the top section 52 with the clamping bar 134 on the left side 58 and the clamping bar 136 on the right side 60 and the clamping bar 138 on the frontside 54. The front side 54 is rectangular in shape. The bottom edge of the crosswalls 62 and the bottom edge of the front side 54, backside 56, left side 58, and right side 60 of the top section 52 form a substantially flat bed surface. FIG. 3 is a side view of the top section 52 and the right side 60 is rectangular in shape. It shows the clamping bar 136 on the right side 60 and the clamping bar 138 on the front side 54 and the clamping bar 140 on the back side 56.

Figure 4:
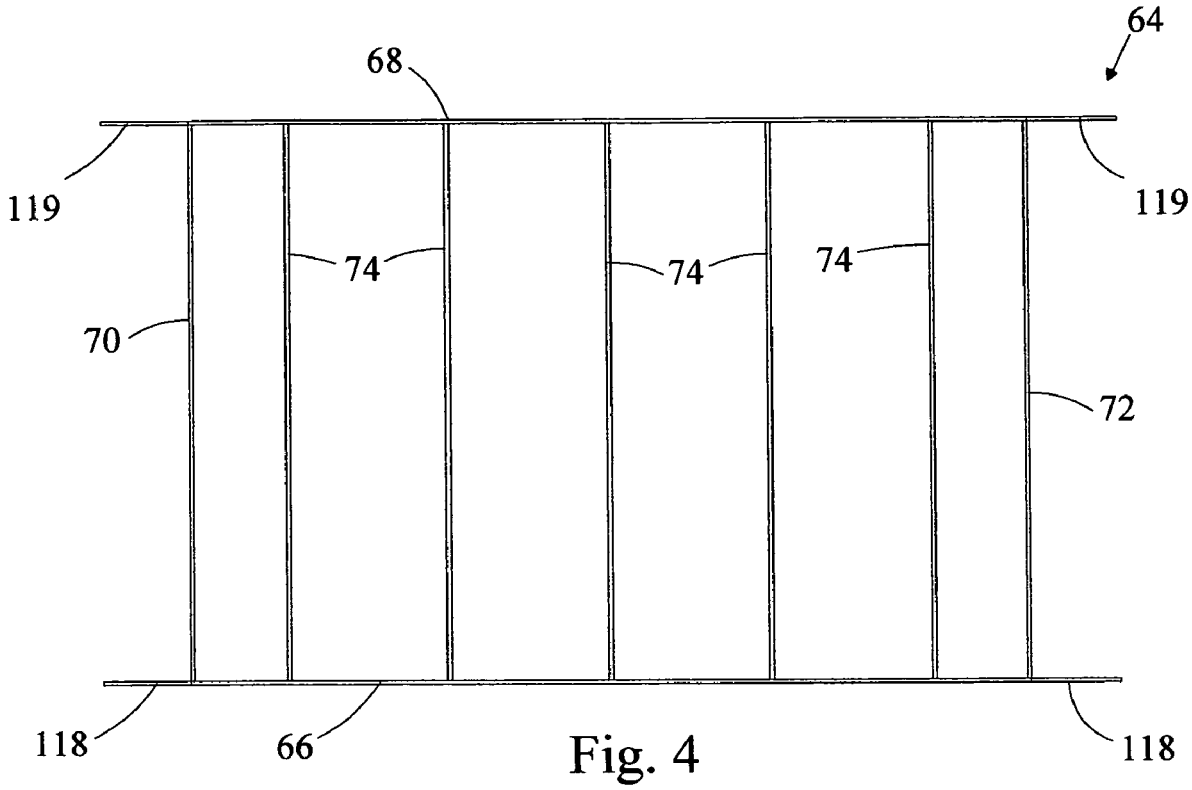
FIG. 4 is a top view of the bottom section of the present invention.
Figure 5:
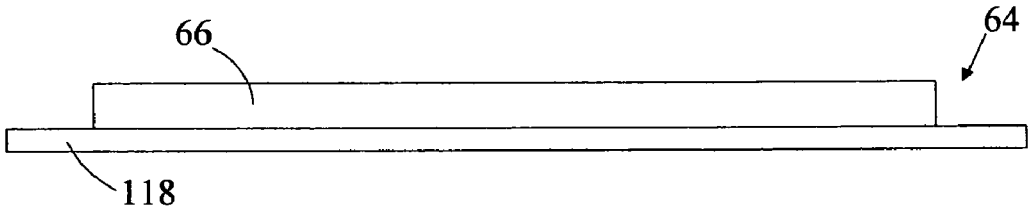
FIG. 5 is a front view of the bottom section of the present invention.
Figure 6:
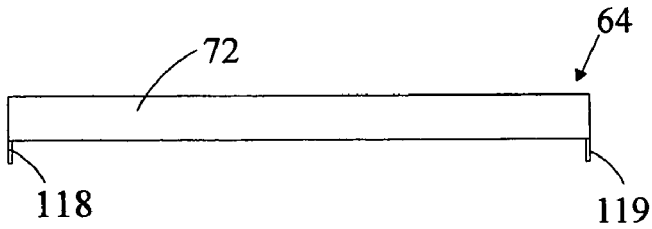
FIG. 6 is a side view of the bottom section of the present invention.

FIG. 4 is a top view of the bottom section 64 with a front side 66, a back side 68, a left side 70, a right side 72, and crosswalls 74 that extend from the front side 66 to the back side 68 and are substantially parallel to the left side 70 and the right side 72. There is a clamping bar 118 attached to the bottom of the front side 66 and a clamping bar 119 attached to the bottom of the back side 68. The bottom section 64 is rectangular in shape. FIG. 5 is a front view of the bottom section 64 and it shows the clamping bar 118 attached to the bottom of the front side 66. The front side 66 is rectangular in shape. The top edge of the crosswalls 74 and the top edge of the front side 66, backside 68, left side 70, and right side 72 form a substantially flat bed surface. FIG. 6 is a side view of the bottom section 64 and the clamping bar 118 attached to the bottom of the front side 66 and the clamping bar 119 attached to the bottom of the back side 68 and it shows the right side 72 is rectangular in shape.

Figure 7:
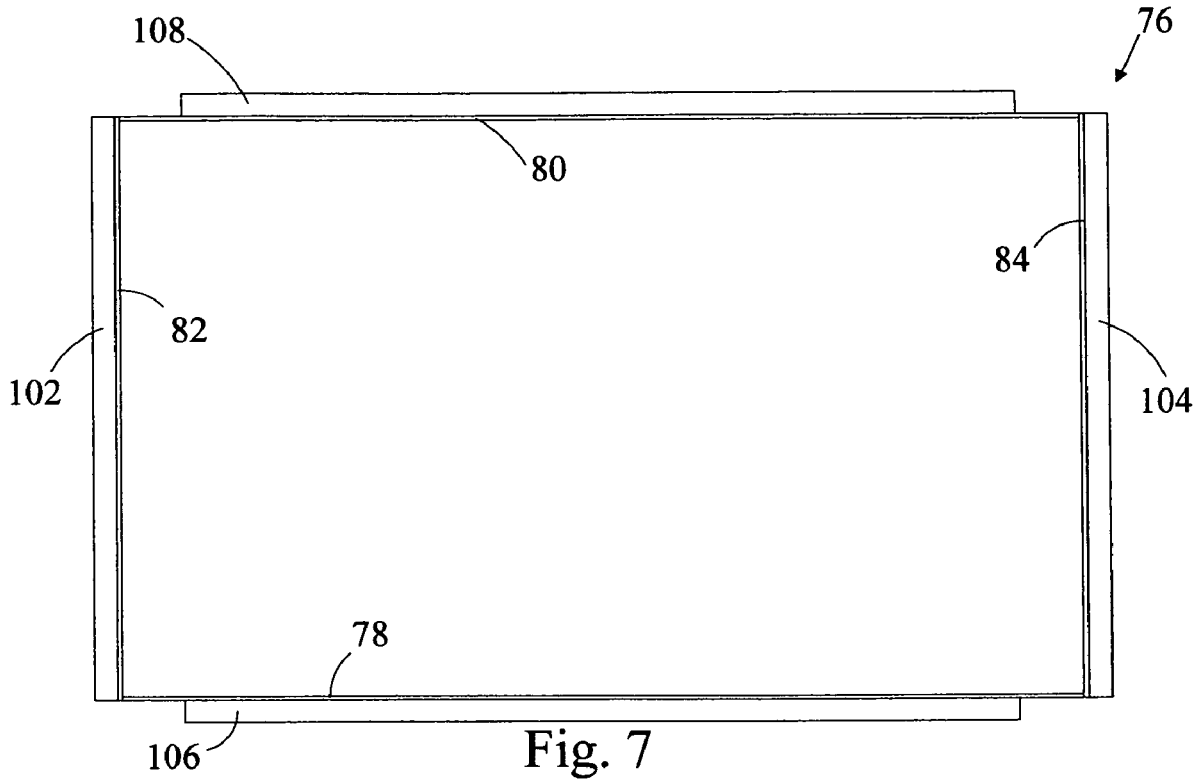
FIG. 7 is a top view of the middle section of the present invention.
Figure 8:
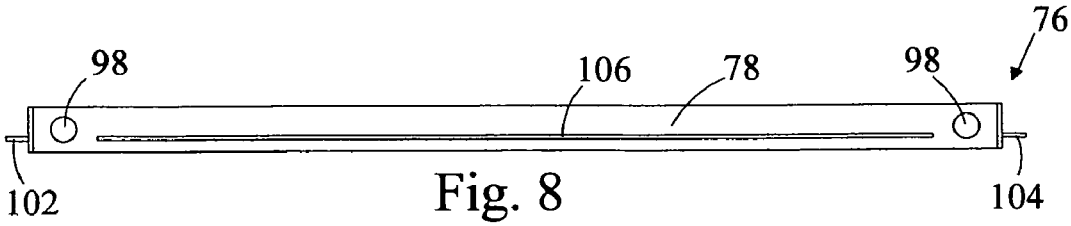
FIG. 8 is a front view of the middle section of the present invention.
Figure 9:
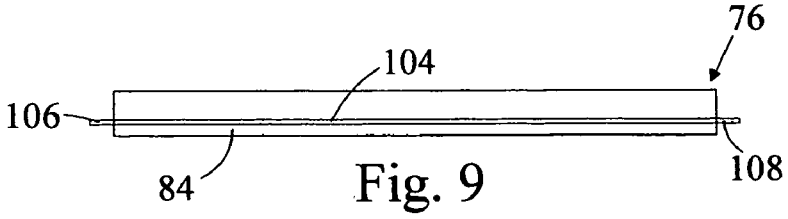
FIG. 9 is a side view of the middle section of the present invention.

FIG. 7 is a top view of the middle section 76 which has a rectangular shape. The middle section 76 has a front side 78, a back side 80, a left side 82, and a right side 84. The top edge of the front side 78, back side 80, left side 82, and right side 84 form a bed having a substantially flat bed surface. There is a clamping bar 102 attached to the left side 82 and a clamping bar 104 attached to the right side 84. There is a clamping bar 106 attached to the front side 78 and a clamping bar 108 attached to the back side 80. There is at least one first direction clamp 86 adjacent to the left side 82 and at least one first direction clamp 86 adjacent to the right side 84 which cause a first direction compressive force on a workpiece 124, comprising members of wood glued edge-to-edge, and the members of wood are substantially parallel to the front side 78 of the middle section 76. FIG. 8 is a front view of the middle section 76 and it shows the holes 98 in the front side 78 that first direction clamps 86 are passed through. It shows the clamping bar 102 on the left side 82 and the clamping bar 104 on the right side 84 and the clamping bar 106 on the front side 78. FIG. 9 is a side view of the middle section 76. It shows the clamping bar 104 on the right side 84 and the clamping bar 106 on the front side 78 and the clamping bar 108 on the back side 80.

Figure 10:
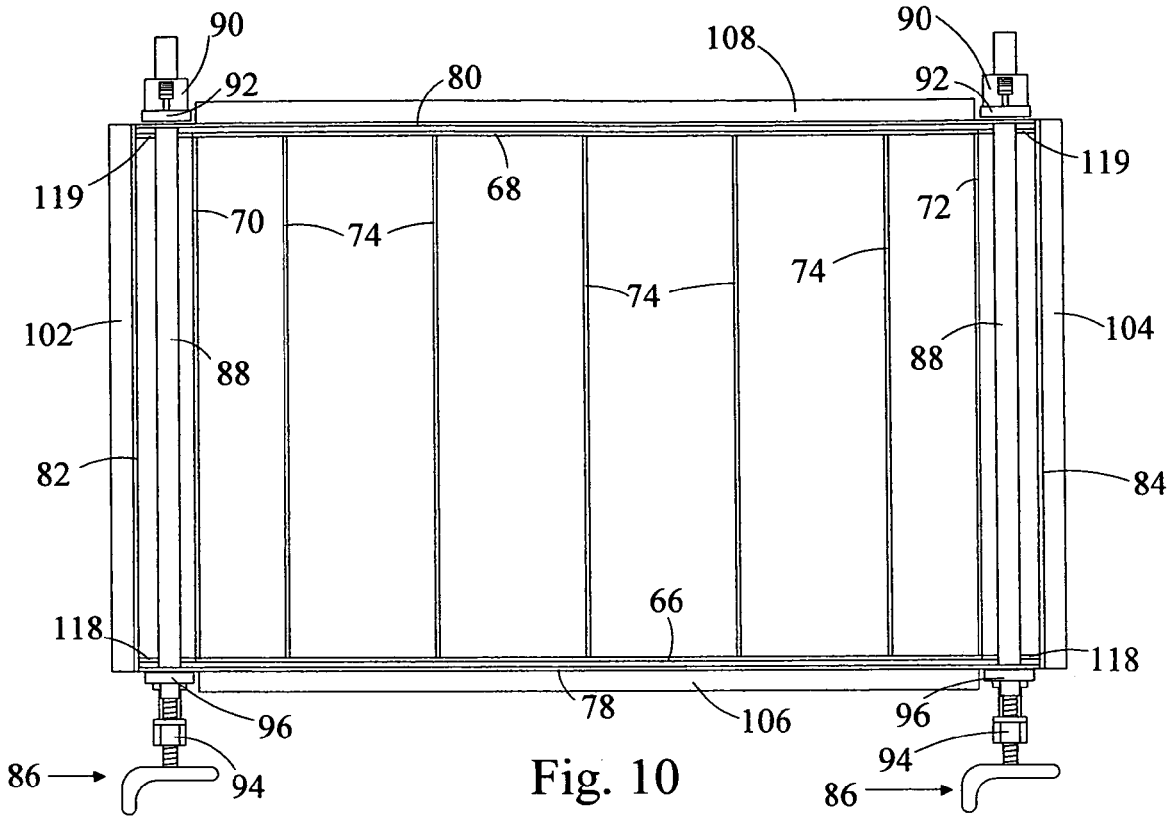
FIG. 10 is a top view of the middle section and bottom section of the present invention.

FIG. 10 is a top view of the bottom section 64 positioned between the first direction clamps 86 of the middle section 76 and the front side 78 and back side 80 of the middle section 76. The first direction clamps 86 are next to the left side 82 and right side 84 of the middle section 76. The body 88 of the first direction clamp 86 is passed through a hole 98 (not shown) in the front side 78 of the middle section 76 and passed through a hole 98 (not shown) in the back side 80 of the middle section 76. The first direction clamps 86 are substantially perpendicular to the front side 78 of the middle section 76 and substantially perpendicular to the back side 80 of the middle section 76. The front side 66 of the bottom section 64 is adjacent and inside the front side 78 of the middle section 76, the back side 68 of the bottom section 64 is adjacent and inside the back side 80 of the middle section 76, the left side 70 of the bottom section 64 is adjacent and inside the first direction clamp 86 next to the left side 82 of the middle section 76, and the right side 72 of the bottom section 64 is adjacent and inside the first direction clamp 86 next to the right side 84 of the middle section 76. In another embodiment, there is a reinforcing plate (not shown) for the holes 98 on the front side 78 and back side 80 of the middle section 76 and the reinforcing plate (not shown) is located on the inside of the front side 78 and inside of the back side 80 of the middle section 76. The reinforcing plate (not shown) has a hole the same diameter as the hole 98 in the front side 78 and back side 80 of the middle section 76. The dimensions and position of the reinforcing plate cannot interfere with the bottom section 64. The reinforcing plate (not shown) is rectangular in shape and the height is equal or less than the height of the front side 78 of the middle section 76, it does not project any higher than the top edge or lower than the bottom edge of the front side or back side, and the length is equal or less than the distance from the outside of the left side 70 of the bottom section 64 and the inside of the left side 82 of the middle section 76.

Figure 11:
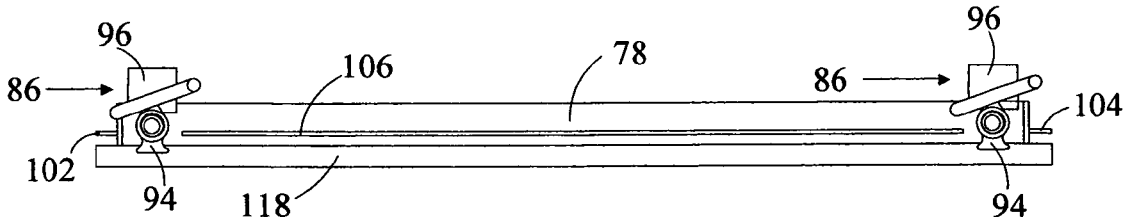
FIG. 11 is a front view of the middle section and bottom section of the present invention.
Figure 12:
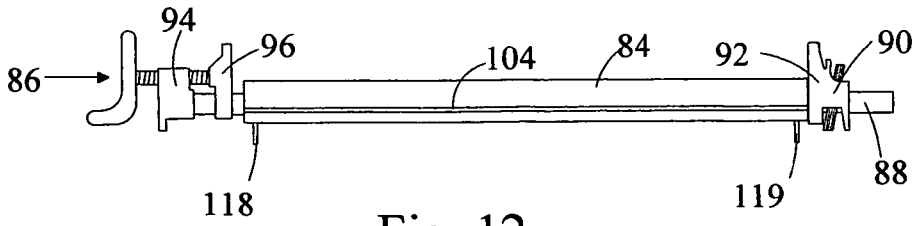
FIG. 12 is a side view of the middle section and bottom section of the present invention.

FIG. 11 is a front view of the bottom section 64 and the middle section 76 and the first direction clamps 86. The clamping bar 118 is attached to the bottom of the front side 66 of the bottom section 64. It shows the clamping bar 102 on the left side 82 of the middle section 76 and the clamping bar 104 on the right side 84 of the middle section 76 and the clamping bar 106 on the front side 78 of the middle section 76. FIG. 12 is a side view of the bottom section 64 and the middle section 76 and the first direction clamp 86. It shows the clamping bar 104 attached to the right side 84 of the middle section 76. It shows the clamping bar 118 attached to the bottom of the front side 66 and the clamping bar 119 attached to the bottom of the back side 68 of the bottom section 64.

In FIG. 13 through FIG. 17, the distance between the outside of the back side 80 of the middle section 76 to the outside of the front side 78 of the middle section 76 is 26". The workpiece 124 comprises six members of wood and the total width of the six members of wood is 20½". There is a 2" wide spacer bar 126 against the flat inner face 92 of the footpiece 90 of the first direction clamp 86 and the workpiece is against the 2" wide spacer bar 126 and a 1" wide spacer bar 126 and a 3" wide spacer bar 126 are between the workpiece 124 and the flat face 96 of the headpiece 94 of the first direction clamp 86. The outermost spacer bar 126 projects ½" outside of the front side 78 of the middle section 76.

Figure 13:
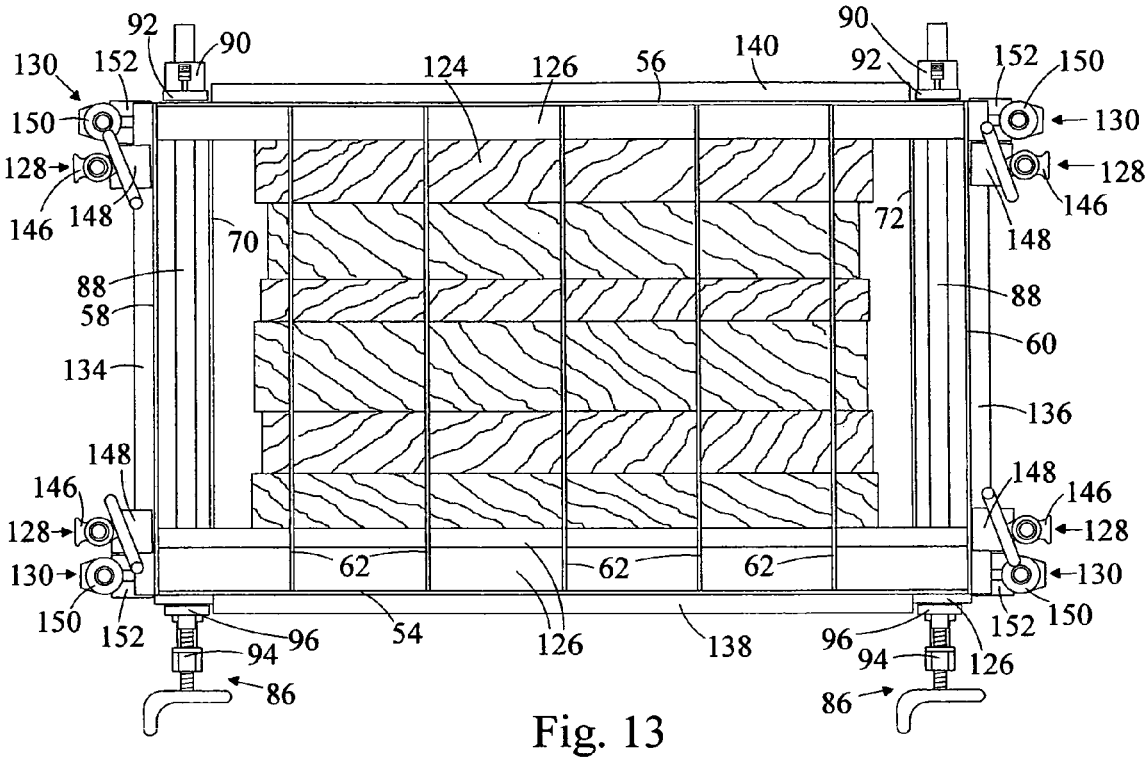
FIG. 13 is a top view of the bottom section, middle section, and top section of the present invention with second direction clamps.

FIG. 13 is a top view of the clamping apparatus and it shows the first direction clamps 86 and second direction clamps. The workpiece 124 is placed on top of the bed formed by the top edge of the front side 66, back side 68, left side 70, right side 72, and crosswalls 74 of the bottom section 64 and the top edge of the front side 78, back side 80, left side 82, and right side 84 of the middle section 76. The flat inner face 92 of the footpiece 90 is outside of the back side 80 of the middle section 76 and in contact with the back side 80 of the middle section 76. Part of the flat inner face 92 of the footpiece 90 of the first direction clamp 86 extends above the back side 80 of the middle section 76. The headpiece 94 of the first direction clamp 86 is outside and not in contact with the front side 78 of the middle section 76 because it must be able to exert a compressive force on the workpiece 124 in a first direction. In one embodiment, the headpiece 94 of the first direction clamp 86 is about 1/16" to about 5" outside of the front side 78 of the middle section 76. In another embodiment, the flat face 96 of the headpiece 94 of the first direction clamp 86 is about ⅛" to about 2" outside of the front side 78 of the middle section 76. Part of the flat face 96 of the headpiece 94 of the first direction clamp 86 extends above the front side 78 of the middle section 76.

The top section 52 is positioned above the middle section 76 and the front side 54 of the top section 52 is above the front side 78 of the middle section 76 and the length of the front side 54 of the top section 52 is about the same length as the front side 78 of the middle section 76, the back side 56 of the top section 52 is above the back side 80 of the middle section 76 and the length of the back side 56 of the top section 52 is about the same length as the back side 80 of the middle section 76, the left side 58 of the top section 52 is above the left side 82 of the middle section 76 and the length of the left side 58 of the top section 52 is about the same length as the left side 82 of the middle section 76, and the right side 60 of the top section is above the right side 84 of the middle section 76 and the length of the right side 60 of the top section 52 is about the same length as the right side 84 of the middle section 76.

The workpiece 124 is subjected to a compressive force in the first direction from the first direction clamps 86 and a compressive force in a second direction substantially perpendicular to the first direction force from the second direction clamps 128 between the top section 52 and middle section 76. The second direction clamps 130 between the bottom section 64 and middle section 76 raise the bottom section 64 within the middle section 76 and positions the top edge of the left side 70, right side 72, front side 66, back side 68, and crosswalls 74 of the bottom section 64 and the top edge of the left side 82, right side 84, front side 78, and back side 80 of the middle section 76 in a substantially flat bed surface. In one embodiment, the height of the front side 66, back side 68, left side 70, right side 72, and crosswalls 74 of the bottom section 64 and the height of the front side 78, back side 80, left side 82, and right side 84 of the middle section 76 are the same height. The workpiece 124 is placed on the flat bed surface. The top edge of the crosswalls 74 in the bottom section 64 is the edge in contact with the bottom of the workpiece 124. The bottom edge of the crosswalls 62 in the top section 52 is the edge in contact with the top of the workpiece 124.

Figure 14:
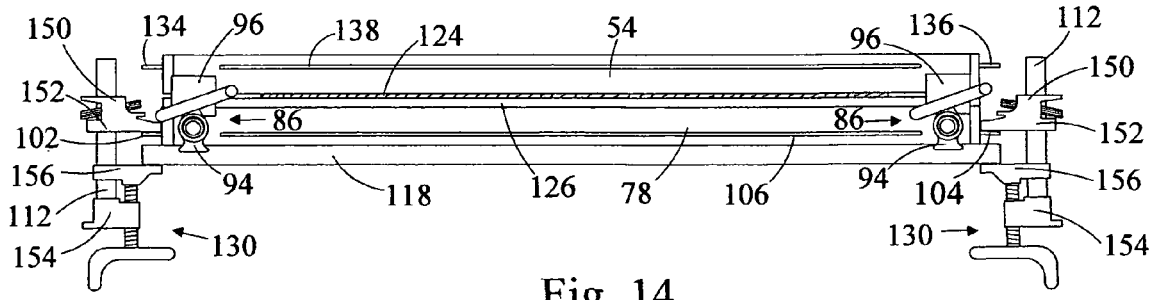
FIG. 14 is a front view of the bottom section, middle section, and top section of the present invention with no second direction clamps (for clarity purposes) between the top section and middle section.
Figure 15:
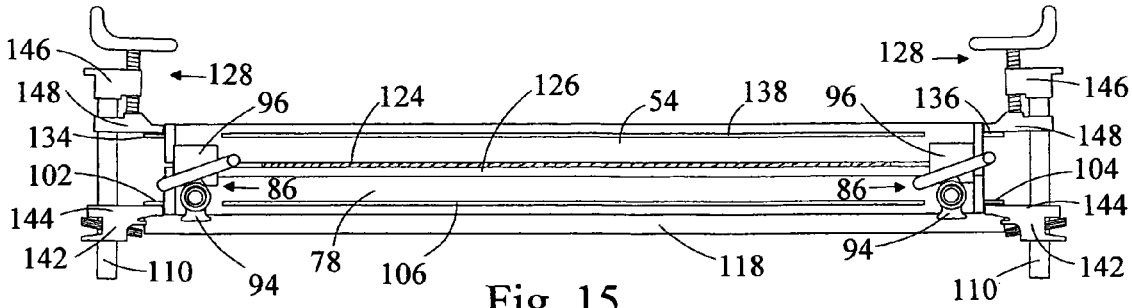
FIG. 15 is a front view of the bottom section, middle section, and top section of the present invention with no second direction clamps (for clarity purposes) between the bottom section and middle section.
Figure 16:
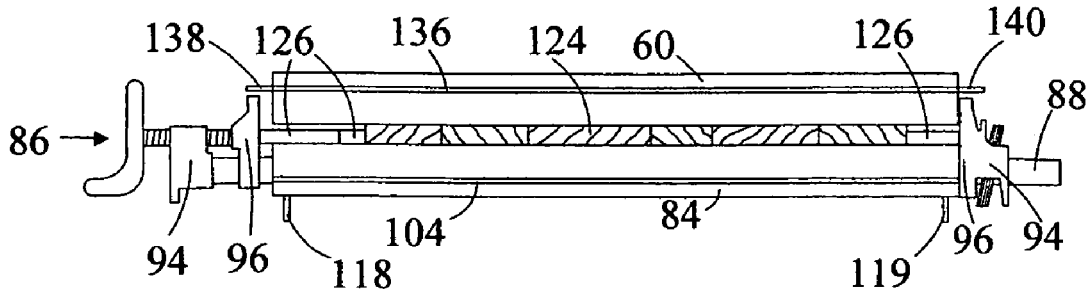
FIG. 16 is a side view of the bottom section, middle section, and top section of the present invention with no second direction clamps (for clarity purposes).
Figure 17:
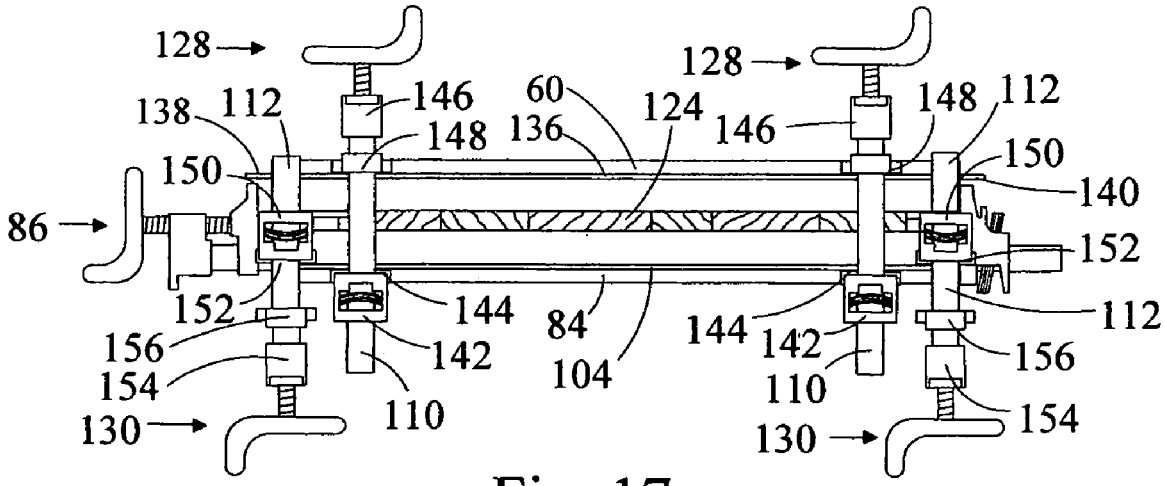
FIG. 17 is a side view of the bottom section, middle section, and top section of the present invention with second direction clamps.

FIG. 14 and FIG. 15 are front views of the clamping apparatus with some clamps not shown in each drawing to better understand the drawing. FIG. 14 does not show the second direction clamps 128 between the middle section 76 and top section 52. FIG. 15 does not show the second direction clamps 130 between the middle section 76 and bottom section 64. FIG. 16 and FIG. 17 are side views of the clamping apparatus with no second direction clamps shown in FIG. 16 to better understand the drawing. FIG. 17 shows all of the second direction clamps which include the second direction clamps 130 between the bottom section 64 and middle section 76 and the second direction clamps 128 between the top section 52 and middle section 76.

In one embodiment, there is one first direction clamp 86 adjacent to the left side 82 of the middle section 76 and one first direction clamp 86 adjacent to the right side 84 of the middle section 76. The first direction clamp 86 comprises at least one clamp from the following group: pipe clamp, bar clamp, parallel clamp, and a threaded rod with one or more fasteners. The second direction clamps comprise at least one clamp from the following group: C-clamp, adjustable hand screw clamp, spring clamp, pipe clamp, bar clamp, parallel clamp, F style clamp, and a threaded rod with one or more fasteners. In one embodiment, the fastener for the threaded rod is a nut.

In one embodiment, there are one or more second direction clamps 130 between the clamping bar 118 attached to the bottom of the front side 66 of the bottom section 64 and the clamping bar 102 attached to the left side 82 of the middle section 76, one or more second direction clamps 130 between the clamping bar 118 attached to the bottom of the front side 66 of the bottom section 64 and the clamping bar 104 attached to the right side 84 of the middle section 76, one or more second direction clamps 130 between the clamping bar 119 attached to the bottom of the back side 66 of the bottom section 64 and the clamping bar 102 attached to the left side 82 of the middle section 76, and one or more second direction clamps 130 between the clamping bar 119 attached to the bottom of the back side 66 of the bottom section 64 and the clamping bar 104 attached to the right side 84 of the middle section 76.

In another embodiment, one second direction clamp 130 is between the clamping bar 118 attached to the bottom of the front side 66 of the bottom section 64 and the clamping bar 102 attached to the left side 82 of the middle section 76, one second direction clamp 130 is between the clamping bar 118 attached to the bottom of the front side 66 of the bottom section 64 and the clamping bar 104 attached to the right side 84 of the middle section 76, one second direction clamp 130 is between the clamping bar 119 attached to the bottom of the back side 68 of the bottom section 64 and the clamping bar 102 attached to the left side 82 of the middle section 76, and one second direction clamp 130 is between the clamping bar 119 attached to the bottom of the back side 68 of the bottom section 64 and the clamping bar 104 attached to the right side 84 of the middle section 76.

There are one or more second direction clamps 128 between the clamping bar attached to the top section 52 and the clamping bar directly below it that is attached to the middle section 76. The second direction clamps 128 can be positioned between the clamping bar 102 on the left side 82 of the middle section 76 and the clamping bar 134 on the left side 58 of the top section 52, the clamping bar 104 on the right side 84 of the middle section 76 and the clamping bar 136 on the right side 60 of the top section 52, the clamping bar 106 on the front side 78 of the middle section 76 and the clamping bar 138 on the front side 54 of the top section 52, and the clamping bar 108 on the back side 80 of the middle section 76 and the clamping bar 140 on the back side 56 of the top section 52. They cause a compression of the top section 52 and middle section 76 in a second direction substantially perpendicular to the first direction compressive force. This applies a compressive force against the workpiece 124 in a second direction substantially perpendicular to the first direction compressive force.

Each of the first direction clamps 86 and the second direction clamps 130 between the bottom section 64 and middle section 76 and second direction clamps 128 between the top section 52 and middle section 76 is independently operable. The second direction clamps 130 between the bottom section 64 and the middle section 76 can be tightened or loosened and removed without affecting the first direction clamps 86 and the second direction clamps 128 between the top section 52 and middle section 76 and the position of the top section 52. The bottom section 64 can be removed and the workpiece 124 continues to be compressed by the first direction clamps 86 and continues to be against the top section 52. The second direction clamps 128 between the top section 52 and middle section 76 can be tightened or loosened and removed without affecting the first direction clamps 86 and the second direction clamps 130 between the bottom section 64 and middle section 76 and the position of the bottom section 64. The top section 52 can be removed and the workpiece 124 continues to be compressed by the first direction clamps 86 and continues to be against the bottom section 64. Holes or a suitable fixture can be located in parts of the top section 52 and bottom section 64 to hold the top section 52 and bottom section 64 after it has been removed.

The clamping bar is rectangular in shape and can vary in width. In one embodiment, the width of the clamping bar is about ½" to about 3". In another embodiment, the width of the clamping bar is about ¾" to about 1½". In one embodiment, at least one clamping bar and the side of the section are manufactured as a single, integral part and the clamping bar is not a separate part that is attached to the side of the section because the side and the clamping bar are manufactured as one integral part. The side and clamping bar are one piece that is molded or folded to create a side and clamping bar.

The clamping bar 118 attached to the bottom of the front side 66 of the bottom section 64 and the clamping bar 119 attached to the bottom of the back side 68 of the bottom section 64 extend from the outside edge of the clamping bar 102 attached to the left side 82 of the middle section 76 to the outside edge of the clamping bar 104 attached to the right side 84 of the middle section 76. The clamping bar 102 on the left side 82 of the middle section 76 and the clamping bar 104 on the right side 84 of the middle section 76 extend from the outside edge of the front side 78 to the outside edge of the back side 80 of the middle section 76. The clamping bar 134 on the left side 58 of the top section 52 and the clamping bar 136 on the right side 60 of the top section 52 extend from the outside edge of the front side 54 to the outside edge of the back side 56 of the top section 52. The clamping bar 106 on the front side 78 of the middle section 76 extends between the first direction clamps 86 and the clamping bar 108 on the back side 80 of the middle section 76 extends between the first direction clamps 86. The clamping bar 138 attached to the front side 54 of the top section 52 is about the same length and directly above the clamping bar 106 attached to the front side 78 of the middle section 76. The clamping bar 140 attached to the back side 56 of the top section 52 is about the same length and directly above the clamping bar 108 attached to the back side 80 of the middle section 76.

In one embodiment, the bottom edge of the clamping bar 102 attached to the left side 82 of the middle section 76 is about ½" from the bottom edge of the left side 82 of the middle section 76. The bottom of the clamping bar 104 attached to the right side 84 of the middle section 76 is about ½" from the bottom edge of the right side 84 of the middle section 76. This will prevent any substance used to adhere the clamping bars such as weld to project lower than the bottom edge of the left side 82 and right side 84 of the middle section 76. It will also increase the distance between the top edge of the clamping bar 102 on the left side 82 of the middle section 76 and the bottom edge of the clamping bar 134 on the left side 58 of the top section 52 and the distance between the top edge of the clamping bar 104 on the right side 84 of the middle section 76 and the bottom edge of the clamping bar 136 on the right side 60 of the top section 52. Increasing this distance will prevent the footpiece 150 of the second direction clamps 130 between the bottom section 64 and middle section 76 from contacting the clamping bar 134 on the left side 58 of the top section 52 and the clamping bar 136 on the right side 60 of the top section 52. Increasing this distance is also achieved when the top edge of the clamping bar 134 attached to the left side 58 of the top section 52 is about ½" from the top edge of the left side 58 of the top section 52 and the top edge of the clamping bar 136 attached to the right side 60 of the top section 52 is about ½" from the top edge of the right side 60 of the top section 52.

The clamping bar 106 attached to the front side 78 of the middle section 76 must be at least ½" from the top of the front side 78 of the middle section 76 to prevent any substance used to adhere the clamping bar such as weld to project higher than the top of the front side 78 of the middle section 76. The clamping bar 108 attached to the back side 80 of the middle section 76 must be at least ½" from the top of the back side 80 of the middle section 76 to prevent any substance used to adhere the clamping bar such as weld to project higher than the top of the back side 80 of the middle section 76. The clamping bar 138 attached to the front side 54 of the top section 52 must be at least ½" from the bottom of the front side 54 of the top section 52 to prevent any substance used to adhere the clamping bar 138 such as weld to project lower than the bottom of the front side 54 of the top section 52. The clamping bar 140 attached to the back side 56 of the top section 52 must be at least ½" from the bottom of the back side 56 of the top section 52 to prevent any substance used to adhere the clamping bar 140 such as weld to project lower than the bottom of the back side 56 of the top section 52.

In one embodiment, there is no clamping bar 106 on the front side 78 of the middle section 76 and no clamping bar 108 on the back side 80 of the middle section 76 and no clamping bar 138 on the front side 54 of the top section 52 and no clamping bar 140 on the back side 56 of the top section 52. The only clamping bars attached to the middle section 76 and the top section 52 are the clamping bar 102 attached to the left side 82 of the middle section 76, clamping bar 104 attached to the right side 84 of the middle section 76, clamping bar 134 attached to the left side 58 of the top section 52, and clamping bar 136 attached to the right side 60 of the top section 52.

One or more spacer bars 126 can be used adjacent to the workpiece 124 to fill the space between the flat inner face 92 of the footpiece 90 of the first direction clamp 86 and the flat face 96 of the headpiece 94 of the first direction clamp 86. The spacer bars 126 are rectangular in shape and are positioned substantially parallel to the front side 78 of the middle section 76 and have about the same length as the front side 78 of the middle section 76. The height of the spacer bars 126 must be equal or less than the height of the workpiece 124. The height of the spacer bars 126 cannot be substantially less than the height of the workpiece 124 or there will less pressure at the top edge than the bottom edge of the workpiece 124. In one embodiment, the height of the spacer bars is about 1/64" to about ¼" less than the height of the workpiece 124. In another embodiment, the height of the spacer bar is about 1/64" to about ⅛" less than the height of the workpiece 124. The width of the spacer bars 126 can vary. In one embodiment, the width of the spacer bars 126 is about ¼" to about 10". In another embodiment, the width of the spacer bars 126 is about 1" to about 5".

The spacer bars 126 can be placed in three different locations relative to the workpiece 124 between the flat inner face 92 of the footpiece 90 and the flat face 96 of the headpiece 94 of the first direction clamp 86: (1) one or more spacer bars 126 are positioned against the flat inner face 92 of the footpiece 90 and the workpiece 124 is positioned between the spacer bar 126 closest to the front side 78 of the middle section 76 and the flat face 96 of the headpiece 94, (2) the workpiece 124 is positioned against the flat inner face 92 of the footpiece 90 and one or more spacer bars 126 are positioned between the workpiece 124 and the flat face 96 of the headpiece 94, and (3) one or more spacer bars 126 are positioned against the flat inner face 92 of the footpiece 90 and the workpiece 124 is positioned against the spacer bar 126 closest to the front side 78 of the middle section 76 and one or more spacer bars 126 are positioned between the workpiece 124 and the flat face 96 of the headpiece 94.

In one embodiment, the end opposite the headpiece of at least one second direction clamp has a threaded end on the body of the second direction clamp. A circular hole is placed in the clamping bar and the threaded end can be passed through the hole in the clamping bar. The threaded end can be secured to the clamping bar with one or more fasteners. In one embodiment, the fastener is a nut. The composition of the top section 52, middle section 76, bottom section 64, clamping bars, and spacer bars 126 is made of at least one material from the following materials: steel, steel alloy, aluminum, plastic, polyolefin, resin, fiberglass, ABS, monomer, polymer, wood, and stainless steel. In one embodiment, at least part of the top section 52, middle section 76, bottom section 64, clamping bars, and spacer bars 126 is coated with a material that does not readily adhere to wood glue. The components for the top section 52, middle section 76, bottom section 64, and clamping bars are attached to each other using at least one of the following materials: adhesive, weld, and mechanical fastener. In one embodiment, one or more sides of the top section, crosswalls of the top section, sides of the middle section, sides of the bottom section, crosswalls of the bottom section, clamping bars, and spacer bars have a rectangular shape with a solid core with a wall thickness of about 1/32" to about 3/16". In another embodiment, one or more sides of the top section, crosswalls of the top section, sides of the middle section, sides of the bottom section, crosswalls of the bottom section, clamping bars, and spacer bars have a rectangular shape with a hollow core with a wall thickness of about 1/32" to about 3/16".

The height of the sides can vary. In one embodiment, the height of the sides of the middle section 76, bottom section 64, and top section 52 is about 1½" to about 5". In another embodiment, the height of the sides of the middle section 76, bottom section 64, and top section 52 is about 2" to about 4".

The number of crosswalls 62 and the distance between the crosswalls 62 can vary in the top section 52 and the number of crosswalls 74 and the distance between the crosswalls 74 can vary in the bottom section 64. In one embodiment, the bottom section 64 has the same number of crosswalls 74 as the number of crosswalls 62 in the top section 52. In one embodiment, the spacing of the crosswalls 62 in the top section 52 is uniform. In one embodiment, the spacing of the crosswalls 74 in the bottom section 64 is uniform. In another embodiment, the bottom section 64 has the same number of crosswalls 74 as the top section 52 and the crosswalls 74 in the bottom section 64 are directly below the crosswalls 62 in the top section 52.

In one embodiment, the top section 52 has no bracing pieces between the crosswalls 62 and between the left side 58 and the adjacent crosswall 62 and the right side 60 and the adjacent crosswall 62. In another embodiment, the top section 52 has one or more bracing pieces (not shown) between the crosswalls 62 and between the left side 58 and the adjacent crosswall 62 and the right side 60 and the adjacent crosswall 62. The bracing pieces (not shown) in the top section 52 do not extend below the bottom edge of the crosswalls 62 in the top section 52. In one embodiment, the bottom section 64 has no bracing pieces between the crosswalls 74 and between the left side 70 and the adjacent crosswall 74 and the right side 72 and the adjacent crosswall 74. In another embodiment, the bottom section 64 has one or more bracing pieces (not shown) between the crosswalls 74 and between the left side 70 and the adjacent crosswall 74 and the right side 72 and the adjacent crosswall 74. The bracing pieces (not shown) in the bottom section 64 do not extend above the top edge of the crosswalls 74 in the bottom section 64.

The length and width of the clamped apparatus can vary. In one embodiment, the width of the middle section 76 from the outside of the front side 78 to the outside of the back side 80 is about 12" to about 36" and the length of the middle section 76 from the outside of the left side 82 to the outside of the right side 84 is about 24" to about 72". In another embodiment, the width of the middle section 76 from the outside of the front side 78 to the outside of the back side 80 is about 28" to about 36" and the length of the middle section 76 from the outside of the left side 82 to the outside of the right side 84 is about 56" to about 72". In another embodiment, the width of the middle section 76 from the outside of the front side 78 to the outside of the back side 80 is about 20" to about 28" and the length of the middle section 76 from the outside of the left side 82 to the outside of the right side 84 is about 36" to about 56". In another embodiment, the width of the middle section 76 from the outside of the front side 78 to the outside of the back side 80 is about 12" to about 20" and the length of the middle section 76 from the outside of the left side 82 to the outside of the right side 84 is about 24" to about 42".

The clamping apparatus can rotate around beams (not shown) attached in a fixed position to the middle section 76. In one embodiment, the beams are cylindrical along the total length. In another embodiment, the beams are rectangular on the end attached and fixed to the middle section 76 and cylindrical at the other end that is free to rotate. In one embodiment, the end that is free to rotate is placed in a hole of one or more suitable fixtures. In another embodiment, the end that is free to rotate is placed in one or more bearing blocks that are located on a suitable fixture. In one company, Gopher Bearing Co., that sells bearing blocks, they call them "standard duty pillow blocks". In another embodiment, the end that is free to rotate is placed around another cylinder which has an outside diameter smaller than the inside diameter of the end that is free to rotate. In still another embodiment, the end that is free to rotate is placed inside another cylinder which has an inside diameter larger than the outside diameter of the end that is free to rotate.

There are many embodiments of how the beam (not shown) is attached to the middle section 76. In one embodiment, one end of a beam (not shown) is attached to the center of the left side 82 of the middle section 76 in a fixed position and a beam is attached to the center of the right side 84 of the middle section 76 in a fixed position. In another embodiment, a beam (not shown) is attached to a suitable fixture (not shown) in a fixed position which is attached to the center of the left side 82 of the middle section 76 in a fixed position and a beam (not shown) is attached to a suitable fixture (not shown) in a fixed position which is attached to the center of the right side 84 of the middle section 76 in a fixed position. The beam (not shown) is attached to a suitable fixture (not shown) with one or more of the following methods: weld, adhesive, one or more suitable fasteners, and the beam (not shown) can be screwed into the suitable fixture (not shown). The suitable fixture (not shown) is attached to the left side 82 of the middle section 76 and right side 84 of the middle section 76 with one or more of the following methods: weld, adhesive, and one or more fasteners. In still another embodiment, a beam (not shown) is passed through a hole in the center of the left side 82 of the middle section 76 and held in a fixed position with one or more suitable fasteners and a beam (not shown) is passed through a hole in the center of the right side 84 of the middle section 76 and held in a fixed position with one or more suitable fasteners.

In one embodiment, the clamping bar 102 on the left side 82 of the middle section 76 is continuous and the clamping bar 104 on the right side 84 of the middle section 76 is continuous. In another embodiment, the clamping bar 102 on the left side 82 of the middle section 76 is discontinuous and there is a space in the center of the clamping bar 102 on the left side 82 of the middle section 76 and the clamping bar 104 on the right side 84 of the middle section 76 is discontinuous and there is a space in the center of the clamping bar 104. In another embodiment, the clamping bar 102 on the left side 82 of the middle section 76 is discontinuous and there is about 1" to about 10" space in the center of the clamping bar 102 on the left side 82 of the middle section 76 and the clamping bar 104 on the right side 84 of the middle section 76 is discontinuous and there is about 1" to about 10" space in the center of the clamping bar 104 on the right side 84 of the middle section 76.

What is claimed:

1. A clamping apparatus comprising:

a. a top section that is rectangular in shape with a front side and a back side and a left side and a right side and a plurality of crosswalls positioned between the front side and the back side that are substantially parallel to the left side and right side and a bottom edge of the crosswalls and a bottom edge of the front side, backside, left side, and right side have a substantially flat bed surface, b. a bottom section that is rectangular in shape with a front side and a back side and a left side and a right side and a plurality of crosswalls positioned between the front side and the back side that are substantially parallel to the left side and right side and a top edge of the crosswalls and a top edge of the front side, backside, left side, and right side have a substantially flat bed surface, c. a middle section that is rectangular in shape with a front side and a back side and a left side and a right side and a top edge of the front side, back side, left side, and right side are in a bed having a substantially flat bed surface and at least one first direction clamp proximate the left side of the middle section and at least one first direction clamp proximate the right side of the middle section and a body of the first direction clamp can be passed through a hole in the front side of the middle section and the body of the first direction clamp can be passed though a hole in the back side of the middle section and the first direction clamps are substantially perpendicular to the front side of the middle section and substantially perpendicular to the back side of the middle section and a flat inner face of a footpiece of the first direction clamps is positioned outside and in contact with the back side of the middle section and part of the flat inner face is positioned above the top edge of the back side of the middle section and a flat face of the headpiece of the first direction clamps is positioned from about 1/16" to about 5" outside of the front side of the middle section and part of the flat face of the headpiece is positioned above the top edge of the front side of the middle section and a workpiece comprising members of wood glued edge-to-edge is positioned between the flat inner face of the footpiece and the flat face of the headpiece of the first direction clamps and the workpiece experiences a first direction compressive force, d. the bottom section is positioned within the sides of the middle section wherein the front side of the bottom section is inside and proximate the front side of the middle section, the back side of the bottom section is inside and proximate the back side of the middle section, the left side of the bottom section is inside and proximate the first direction clamp proximate the left side of the middle section, and the right side of the bottom section is inside and proximate the first direction clamp proximate the right side of the middle section, e. the top section is positioned above the middle section and the front side of the top section is above the front side of the middle section and about the same length as the front side of the middle section, the back side of the top section is above the back side of the middle section and about the same length as the back side of the middle section, the left side of the top section is above the left side of the middle section and about the same length as the left side of the middle section, and the right side of the top section is above the right side of the middle section and about the same length as the right side of the middle section, f. the top section has a clamping bar arrangement that comprises at least one arrangement from the group consisting of: a clamping bar is attached to the left side and right side, and a clamping bar is attached to the left side and right side and the front side and back side, g. the middle section has a clamping bar arrangement that comprises at least one arrangement from the group consisting of: a clamping bar is attached to the left side and right side, and a clamping bar is attached to the left side and right side and the front side and back side, h. a clamping bar is attached to a bottom of the front side and a bottom of the back side of the bottom section and one or more second direction clamps are between the clamping bar attached to the bottom of the front side of the bottom section and the clamping bar on the left side of the middle section, one or more second direction clamps are between the clamping bar attached to the bottom of the front side of the bottom section and the clamping bar on the right side of the middle section, one or more second direction clamps are between the clamping bar attached to the bottom of the back side of the bottom section and the clamping bar on the left side of the middle section, and one or more second direction clamps are between the clamping bar attached to the bottom of the back side of the bottom section and the clamping bar on the right side of the middle section for applying a compressive force between the bottom section and middle section in a second direction substantially perpendicular to the first direction compressive force and the top edge of the front side, back side, left side, right side, and crosswalls of the bottom section and the top edge of the front side, back side, left side, and right side of the middle section are in a substantially flat bed surface on which the workpiece is positioned, i. one or more second direction clamps are between the clamping bar attached to the top section and the clamping bar directly below it that is attached to the middle section for applying a compressive force between the top section and middle section in a second direction substantially perpendicular to the first direction compressive force, and j. each of the first direction clamps and the second direction clamps is independently operable.

2. The apparatus of claim 1 further comprising the clamping bar attached to the front side and back side of the middle section is positioned between the first direction clamps and the clamping bar attached to the front side and back side of the top section is about the same length and directly above the clamping bar attached to the front side and back side of the middle section.

3. The apparatus of claim 1 further comprising the length of the clamping bar attached to the bottom of the front side and the clamping bar attached to the bottom of the back side of the bottom section is from an outside edge of the clamping bar on the left side of the middle section to an outside edge of the clamping bar on the right side of the middle section.

4. The apparatus of claim 1 further comprising the length of the clamping bar attached to the left side and right side of the middle section is from an outside edge of the front side to an outside edge of the back side of the middle section.

5. The apparatus of claim 1 further comprising the length of the clamping bar attached to the left side and right side of the top section is from an outside edge of the front side to an outside edge of the back side of the top section.

6. The apparatus of claim 1 further comprising at least one clamping bar and side of a section are manufactured as a single, integral part.

7. The apparatus of claim 1 further comprising there is one first direction clamp proximate the left side of the middle section and one first direction clamp proximate the right side of the middle section.

8. The apparatus of claim 1 further comprising there is one second direction clamp between the clamping bar attached to the bottom of the front side of the bottom section and the clamping bar attached to the left side of the middle section, one second direction clamp between the clamping bar attached to the bottom of the front side of the bottom section and the clamping bar attached to the right side of the middle section, one second direction clamp between the clamping bar attached to the bottom of the back side of the bottom section and the clamping bar attached to the left side of the middle section, and one second direction clamp between the clamping bar attached to the bottom of the back side of the bottom section and the clamping bar attached to the right side of the middle section.

9. The apparatus of claim 1 further comprising the first direction clamp comprises at least one clamp from the group consisting of: pipe clamp, bar clamp, parallel clamp, and threaded rod with one or more fasteners.

10. The apparatus of claim 1 further comprising the second direction clamp comprises at least one clamp from the group consisting of: C-clamp, adjustable hand screw clamp, spring clamp, pipe clamp, bar clamp, parallel clamp, F style clamp, and threaded rod with one or more fasteners.

11. The apparatus of claim 1 further comprising there are one or more spacer bars positioned proximate the workpiece between the flat inner face of the footpiece and the flat face of the headpiece of the first direction clamp wherein the spacer bars have a width from about 1" to, about 5", are rectangular in shape, have a height equal or less than the height of the workpiece, are positioned substantially parallel to the front side of the middle section, and have about the same length as the front side of the middle section.

12. The apparatus of claim 11 further comprising the arrangement of the spacer bars and workpiece comprises at least one arrangement from the group consisting of: one or more spacer bars are positioned against the flat inner face of the footpiece of the first direction clamp and the workpiece is positioned between the spacer bar closest to the front side of the middle section and the flat face of the headpiece of the first direction clamp, the workpiece is positioned against the flat inner face of the footpiece of the first direction clamp and one or more spacer bars are positioned between the workpiece and the flat face of the headpiece of the first direction clamp, and one or more spacer bars are positioned against the flat inner face of the footpiece of the first direction clamp and the workpiece is positioned against the spacer bar closest to the front side of the middle section and one or more spacer bars are positioned between the workpiece and the flat face of the headpiece of the first direction clamp.

13. The apparatus of claim 1 further comprising the bottom section has the same number of crosswalls as the top section and the crosswalls of the bottom section are directly below the crosswalls of the top section.

14. The apparatus of claim 1 further comprising the end opposite a headpiece of at least one second direction clamp has a threaded end which can be passed through a hole in the clamping bar and secured with one or more fasteners.

15. The apparatus of claim 1 further comprising there are one or more bracing pieces in the crosswalls of the bottom section and the crosswalls of the top section in one or more arrangements from the group consisting of: proximate crosswalls in the top section, left side of the top section and the proximate crosswall, right side of the top section and the proximate crosswall, proximate crosswalls in the bottom section, left side of the bottom section and the proximate crosswall, and right side of the bottom section and the proximate crosswall.

16. The apparatus of claim 1 further comprising the composition of the bottom section, middle section, top section, clamping bars, and spacer bars comprises at least one material from the group consisting of: steel, steel alloy, aluminum, plastic, polyolefin, resin, fiberglass, ABS, monomer, polymer, wood, and stainless steel.

17. The apparatus of claim 1 further comprising the shape of the sides of the top section, crosswalls of the top section, sides of the middle section, sides of the bottom section, crosswalls of the bottom section, clamping bars, and spacer bars comprise at least one shape from the group consisting of: rectangular shape with a solid core, and rectangular shape with a hollow core.

18. The apparatus of claim 1 further comprising the clamping bar on the left side of the middle section is discontinuous and there is space in the center of the clamping bar on the left side of the middle section and the clamping bar on the right side of the middle section is discontinuous and there is space in the center of the clamping bar on the right side of the middle section and a cylindrical beam is attached to a suitable fixture in a fixed position which is attached to the center of the left side of the middle section in a fixed position and a cylindrical beam is attached to a suitable fixture in a fixed position which is attached to the center of the right side of the middle section in a fixed position and the other end of the cylindrical beams is positioned in one or more bearing blocks that are located on a suitable fixture.

19. The apparatus of claim 18 further comprising there is about 1" to about 10" space in the center of the clamping bar on the left side of the middle section and there is about 1" to about 10" space in the center of the clamping bar on the right side of the middle section.

* * * * *